US011210983B2

(12) United States Patent
Jang et al.

(10) Patent No.: US 11,210,983 B2
(45) Date of Patent: Dec. 28, 2021

(54) DISPLAY INCLUDING MULTIPLEXER AND CONTROL METHOD THEREOF

(71) Applicant: LG Display Co., Ltd., Seoul (KR)

(72) Inventors: YongHo Jang, Paju-si (KR); TaeWoong Moon, Paju-si (KR); Uyhyun Choi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/597,697

(22) Filed: Oct. 9, 2019

(65) Prior Publication Data

US 2020/0118475 A1 Apr. 16, 2020

(30) Foreign Application Priority Data

Oct. 11, 2018 (KR) ..... 10-2018-0121106

(51) Int. Cl.
*G09G 3/3275* (2016.01)
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2310/0297* (2013.01); *G09G 2330/021* (2013.01)

(58) Field of Classification Search
CPC ..... G09G 3/20; G09G 3/3275; G09G 3/3688; G09G 2310/0275; G09G 2310/0297; G09G 2330/021
See application file for complete search history.

(56) References Cited

U.S. PATENT DOCUMENTS 5,892,728 A * 4/1999 Allen ..... G11C 8/10 365/230.06
10,152,913 B1 * 12/2018 Lin ..... G09G 3/2092
10,559,274 B2 * 2/2020 Xi ..... H03K 17/693
2002/0084971 A1 * 7/2002 Youn ..... G09G 3/3688 345/99
2002/0118154 A1 * 8/2002 Kim ..... G09G 3/3666 345/87
2003/0090614 A1 * 5/2003 Kim ..... G11C 19/28 349/149
2005/0270258 A1 * 12/2005 Shin ..... G09G 3/3275 345/76
2014/0092076 A1 * 4/2014 Lee ..... G09G 3/3291 345/212
2014/0333676 A1 * 11/2014 Fujii ..... G09G 3/3233 345/690

(Continued)

*Primary Examiner* — Mihir K Rayan
(74) *Attorney, Agent, or Firm* — Seed IP Law Group LLP

(57) ABSTRACT

The present disclosure relates to a display, and more particularly, to a display including a multiplexer capable of implementing a high-voltage driving, a low-consumption power driving, and a high-speed switching. A display including a multiplexer according to the present disclosure includes a data driver for outputting image data; a multiplexer connected with the data driver through a driving line; a display panel connected with the multiplexer through a data line; and a gate driver connected with the display panel through a gate line, and the multiplexer includes a first TFT controlled by the charging and the discharging of a first mux line; and a second TFT controlled by the charging and the discharging of a second mux line.

9 Claims, 8 Drawing Sheets

(56) References Cited

U.S. PATENT DOCUMENTS

| | | | | |
|---|---|---|---|---|
| 2015/0035734 | A1* | 2/2015 | Lee | H04J 3/047 345/76 |
| 2016/0293093 | A1* | 10/2016 | Seo | G09G 3/20 |
| 2016/0329025 | A1* | 11/2016 | Park | G09G 3/3648 |
| 2017/0236478 | A1* | 8/2017 | Huang | G09G 3/3648 345/215 |
| 2017/0243559 | A1* | 8/2017 | Xi | G09G 3/3614 |

* cited by examiner

DISPLAY INCLUDING MULTIPLEXER AND CONTROL METHOD THEREOF

CROSS-REFERENCE TO RELATED APPLICATION

This application claims priority to Korean Patent Application No. 10-2018-0121106, filed on Oct. 11, 2018, the disclosure of which is incorporated herein by reference in its entirety.

BACKGROUND

Technical Field

The present disclosure relates to a display and a method for controlling a display.

Description of the Related Art

A display is provided with a multiplexer and the multiplexer selectively connects the data lines connected to the pixels and the driving line connected to the data driver. A multiplexer provided in a conventional display generally adopts a BST structure. Such a BST structure is a structure of additionally requiring two TFTs and one capacitor (2T1C) for controlling driving of one thin film transistor (TFT) in the multiplexer.

Therefore, there is a problem in that the conventional multiplexer adopting the BST structure has a complicated structure, and requires additional formation of TFTs and contact holes, etc., for manufacturing the display, thereby increasing the area of the layout. In addition, there is a problem in that when the characteristics of the BST block are different from each other, local deviation of the charging and the discharging characteristics of the driven TFT of the multiplexer occurs. In addition, there is a problem in that a procedure of charging the capacitor in the BST structure is required, thereby relatively increasing the power consumption in the environment where the driving voltage of the TFT of the multiplexer is the same.

BRIEF SUMMARY

In various embodiments, the present disclosure provides a display including a multiplexer capable of implementing a high-voltage driving, a low-consumption power driving, and a high-speed switching.

A display device including a multiplexer according to the present disclosure includes a data driver for outputting image data; a multiplexer connected with the data driver through a driving line; a display panel connected with the multiplexer through a data line; and a gate driver connected with the display panel through a gate line, and the multiplexer includes a first TFT controlled by the charging and the discharging of a first mux line; and a second TFT controlled by the charging and the discharging of a second mux line.

The multiplexer further includes a first capacitor having one end connected with a first capacitor line and the other end connected with the first mux line; and a second capacitor having one end connected with a second capacitor line and the other end connected with the second mux line.

The gate voltage of the first TFT is controlled by the charging voltage of the first mux line and the charging voltage of the first capacitor, and the gate voltage of the second TFT is controlled by the charging voltage of the second mux line and the charging voltage of the second capacitor.

The multiplexer further includes a leveling TFT having one end connected with the first mux line and the other end connected with the second mux line.

The leveling TFT is controlled by a signal of a leveling line connected to a gate line of the leveling TFT.

When the leveling TFT is turned on by a signal of a leveling line, the gate voltage of the first TFT is transferred to the gate voltage of the second TFT.

The multiplexer further includes a first capacitor having one end connected with a first capacitor line and the other end connected with the first mux line; a second capacitor having one end connected with a second capacitor line and the other end connected with the second mux line; and a leveling TFT having one end connected with the first mux line and the other end connected with the second mux line.

The gate voltage of the first TFT is controlled by the charging voltage of the first mux line and the charging voltage of the first capacitor, and the gate voltage of the second TFT is controlled by the charging voltage of the second mux line and the charging voltage of the second capacitor.

The leveling TFT is controlled by a signal of a leveling line connected to a gate line of the leveling TFT.

When the leveling TFT is turned on by the signal of the leveling line, the gate voltage of the first TFT is transferred to the gate voltage of the second TFT.

The multiplexer further includes a third TFT controlled by the first mux signal transmitted to the first mux line; and a fourth TFT controlled by the second mux signal transmitted to the second mux line, and is configured so that the first TFT and the third TFT share the charging voltage of the first capacitor, and the second TFT and the fourth TFT share the charging voltage of the second capacitor.

A method for controlling a display device including a multiplexer according to the present disclosure includes turning on a first TFT of the multiplexer by charging the voltage of a first mux line; and turning on a second TFT of the multiplexer by charging the voltage of a second mux line.

The method further includes charging a first capacitor having one end connected with a first capacitor line and the other end connected with the first mux line.

The gate voltage of the first TFT is controlled by the charging voltage of the first mux line and the charging voltage of the first capacitor.

The method further includes turning on a leveling TFT having one end connected with the first mux line and the other end connected with the second mux line.

When the leveling TFT is turned on, the gate voltage of the first TFT is transferred to the gate voltage of the second TFT.

The method further includes charging a first capacitor having one end connected with a first capacitor line and the other end connected with the first mux line; and turning on a leveling TFT having one end connected with the first mux line and the other end connected with the second mux line, and the gate voltage of the first TFT is controlled by the charging voltage of the first mux line and the charging voltage of the first capacitor, and when the leveling TFT is turned on, the gate voltage of the first TFT is transferred to the gate voltage of the second TFT.

The display device including the multiplexer according to the present disclosure can implement a high-voltage driving.

In addition, the display device including the multiplexer according to the present disclosure can implement a low-voltage driving.

In addition, the display device including the multiplexer according to the present disclosure can implement a high-speed switching driving.

In addition, the display device including the multiplexer according to the present disclosure can reduce the area of the layout necessary for manufacturing.

DETAILED DESCRIPTION

Hereinafter, embodiments of the present disclosure will be described with reference to the accompanying drawings.

Figure 1:
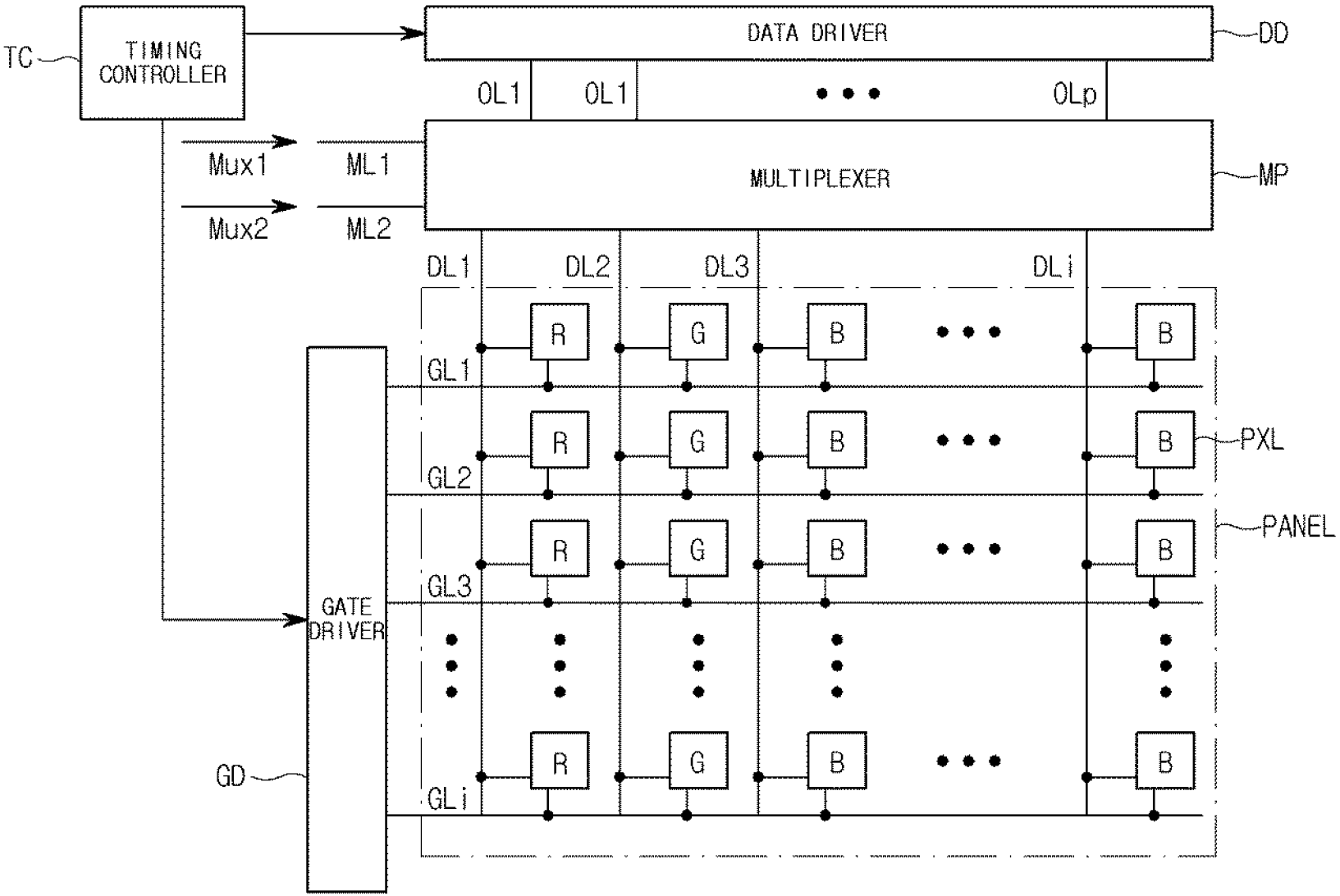
FIG. 1 is a diagram showing a display device according to an embodiment of the present disclosure.

FIG. 1 is a diagram showing a display device according to an embodiment of the present disclosure.

Referring to FIG. 1, a display device according to an embodiment of the present disclosure includes a display panel (PANEL), a data driver (DD), a gate driver (GD), a timing controller (TC), and a multiplexer (MP).

A display panel (PANEL) includes a plurality of pixels (PXL) of horizontal i and vertical j. The display panel (PANEL) is connected with the multiplexer (MP) through i data lines (DL1 to DLi). The display panel (PANEL) is connected with the gate driver (GD) through j gate lines (GL1 to GLj). That is, j pixels (PXL) arranged along one vertical line are commonly connected to one data line (DL1, DL2, etc.). In addition, i pixels (PXL) arranged along one horizontal line are commonly connected to one gate line (GL1, GL2, etc.). The plurality of pixels (PXL) include a plurality of red pixels (R) for displaying a red image, a plurality of green pixels (G) for displaying a green image, and a plurality of blue pixels (B) for displaying a blue image. The plurality of pixels (PXL) are arranged in a matrix form on a display part of the display panel (PANEL). Each of the plurality of pixels (PXL) includes a thin film transistor (TFT) and a pixel electrode. A gate electrode of the thin film transistor is connected to a gate line to which a pixel is connected, a drain electrode of the thin film transistor is connected to a data line to which a pixel is connected, and a source electrode of the thin film transistor is connected to a pixel electrode.

The data driver (DD) transmits i image data for displaying an image to the i data lines (DL1 to DLi) through the multiplexer (MP). The data driver (DD) receives the image data from the timing controller (TC) and transmits them to the data lines (DL1 to DLi). That is, the data driver (DD) transmits red, green, and blue image data corresponding to the i pixels of one horizontal line (GL1, GL2, etc.) driven by the gate driver (GD) to the multiplexer (MP) through p driving lines (OL1 to OLp). That is, the multiplexer (MP) communicates with the data driver (DD) through the driving lines (OL1 to OLp) to transmit the image data to the display panel (PANEL) through the data lines (DL1 to DLi). At this time, the data driver (DD) can divide the image data in two and sequentially output the image data during one horizontal period (1H). That is, the data driver (DD) simultaneously outputs some of the image data among the i image data through the driving lines (OL1 to OLp) during the first half period (1/2H) of one horizontal period, and simultaneously outputs them through the driving lines (OL1 to OLp) during the second half period (2/2H) of one horizontal period.

The multiplexer (MP) time-divides the image data received from the data driver (DD) through the driving lines (OL1 to OLp) and transmits them to the plurality of (i) data lines (DL1 to DLi). One or more embodiments are described herein as having a 2-multiplexer structure. However, other numbers of multiplexer can be used to implement the display device of the present disclosure. The image data received through one driving line (OL1) is output through two data lines (DL1, DL2). The multiplexer (MP) includes a plurality of first half switching elements that maintain the turn-on state during the first half period (1/2H) of one horizontal period and a plurality of second half switching elements that maintain the turn-on state during the second half period (2/2H) of one horizontal period. These first half and second half switching elements can be, for example, thin film transistors (TFT). These switching elements are connected to mux lines (ML1 and ML2). In addition, mux signals (Mux1 and Mux2) control the charging and the discharging of the mux lines (ML1 and ML2) to control ON/OFF of the switching elements. These mux signals (Mux1 and Mux2) are controlled by the gate driver (GD), the timing controller (TC) or an arbitrary input part that is present outside the display panel (PANEL). For example, when the voltage of the mux line (ML1) is charged by the mux signal (Mux1), the switching elements (TFT) connected to the corresponding mux line (ML1) are turned on, and when the voltage of the mux line (ML2) is discharged by the mux signal (Mux2), the switching elements (TFT) connected to the corresponding mux line (ML2) are turned off.

The gate driver (GD) sequentially drives the j gate lines (GL1 to GLj) during one frame period to drive the i pixels (PXL) commonly connected to the corresponding gate line in each horizontal period during which each gate line is driven. The gate driver (GD) sequentially supplies a gate signal to each of the gate lines (GL1 to GLi).

The timing controller (TC) receives the image data from a host system. The timing controller (TC) controls the operation timings of the data driver (DD) and the gate driver (GD) based on the timing signals such as a vertical synchronization signal (V_Sync), a horizontal synchronization signal (H_Sync), a data enable signal (DE), and a main clock signal (Pixel Clock), etc., input from the host system.

The display panel (PANEL) can be implemented as a liquid crystal display panel or an organic light emitting display panel, etc., according to a configuration of the pixel circuit of the pixel (PXL). For example, when the display panel (PANEL) is implemented as a liquid crystal display panel, it is operated in a Twisted Nematic (TN) mode, a Vertical Alignment (VA) mode, an In Plane Switching (IPS) mode, a Fringe Field Switching (FFS) mode, or an Electrically Controlled Birefringence (ECB) mode. For another example, when the display panel (PANEL) is implemented as an organic light emitting display panel, it operates in a Top-Emission mode or a Bottom-Emission mode. A liquid crystal display panel, an organic light emitting display panel, an electrophoretic display panel, a plasma display panel, etc., can be selected as a display panel (PANEL) of the display. However, it should be understood that the present disclosure is not limited to any one thereof.

In addition, the display according to the present disclosure can be implemented as small-sized, medium-sized, or large-sized displays such as a television, a set-top box, a navigation device, a video player, a Blu-ray player, a personal computer, a wearable device, a home theater, a mobile phone, and a Virtual Reality (VR).

Figure 2:
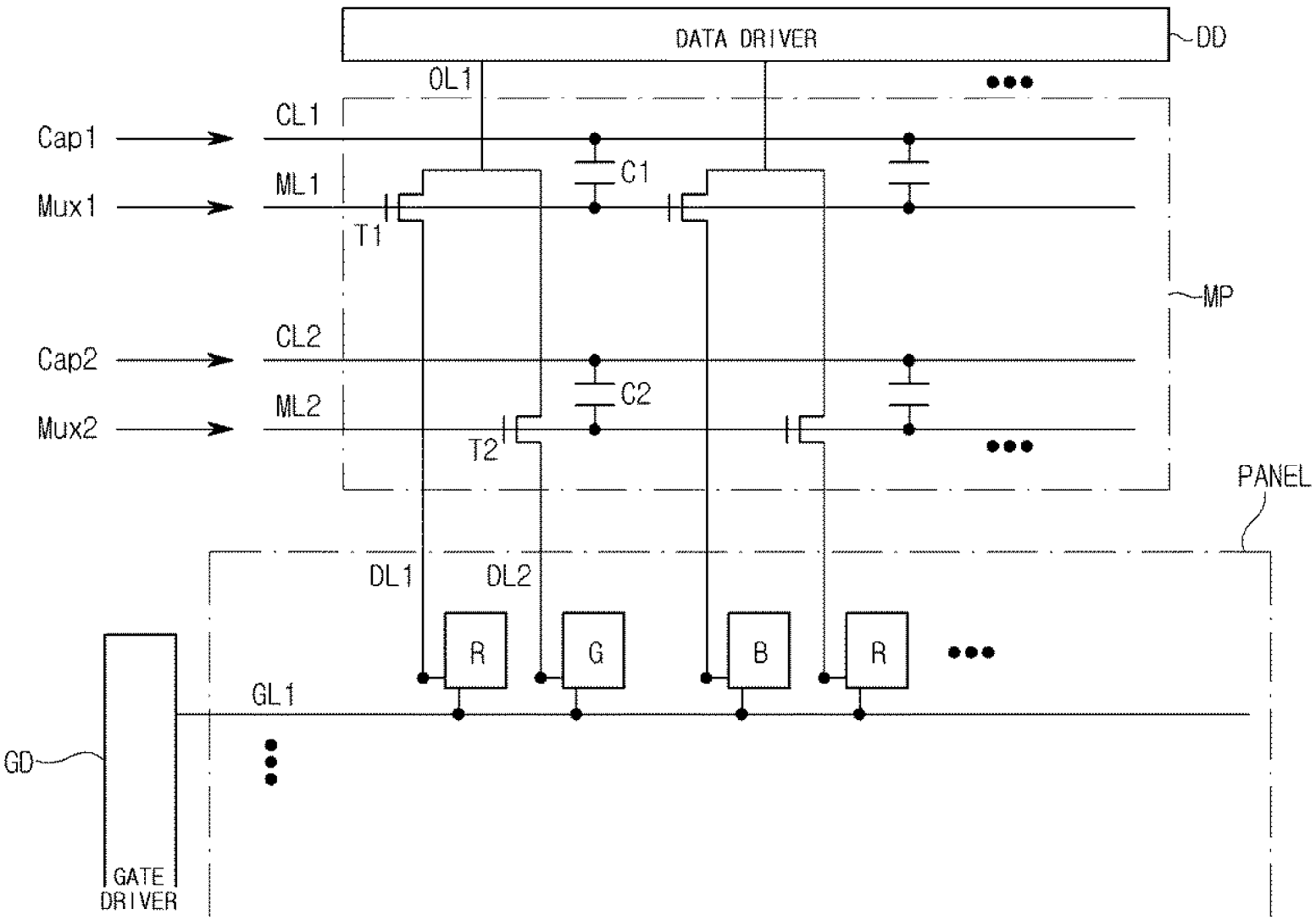
FIG. 2 is a diagram showing a display device including a multiplexer according to the present disclosure.

FIG. 2 is a diagram showing a display device including a multiplexer according to the present disclosure.

Referring to FIG. 2, a display device including a multiplexer according to the present disclosure includes the data driver (DD), the multiplexer (MP) connected with the data driver through the driving line (OL1), the display panel (PANEL) connected with the multiplexer (MP) through the data lines (DL1, DL2), and the gate driver (GD) connected with the display panel (PANEL) through the gate line (GL1).

In some embodiments, the multiplexer (MP) includes two mux TFTs (T1, T2). In other embodiments, the multiplexer (MP) may be implemented based on various numbers of mux TFTs. The voltage charging and voltage discharging of the first mux line (ML1) are controlled by the first mux signal (Mux1) controlled by an arbitrary input part, and the first TFT (T1) is controlled according to the charging and the discharging of this voltage. For example, when the voltage of the first mux line (ML1) is charged by the first mux signal (Mux1), the first TFT (T1) is turned on, and when the voltage of the first mux line (ML1) is discharged by the first mux signal (Mux1), the first TFT (T1) is turned off. In addition, the voltage charging and the voltage discharging of the second mux line (ML2) are controlled by the second mux signal (Mux2) controlled by an arbitrary input part, and the second TFT (T2) is controlled according to the charging and the discharging of this voltage. For example, when the voltage of the second mux line (ML2) is charged by the second mux signal (Mux2), the second TFT (T2) is turned on, and when the voltage of the second mux line (ML2) is discharged by the second mux signal (Mux2), the second TFT (T2) is turned off.

In some embodiments, the multiplexer (MP) includes two capacitors (C1, C2). However, in other embodiments, the multiplexer (MP) may be implemented based on using more or less than two capacitors. One end of the first capacitor (C1) is connected to a first capacitor line (CL1), and the other end of the first capacitor (C1) is connected to the first mux line (ML1). In some embodiments, an end of a capacitor may refer to an electrode at one side of the capacitor. An end of the capacitor may also refer to a plate positioned at one side of the capacitor. For example, a capacitor may have a first electrode or a first plate at one side of the capacitor and a second electrode or a second plate at the other side of the capacitor. The first capacitor (C1) receives a first capacitor signal (Cap1) through the first capacitor line (CL1) and the first capacitor (C1) is controlled by the first capacitor signal (Cap1). For example, when the first capacitor signal (Cap1) is high (logic high or a logic value "1"), the first capacitor (C1) is charged by the corresponding voltage, and when the first capacitor signal (Cap1) is low (logic low or a logic value "0"), the voltage charged in the first capacitor (C1) is discharged. One end of the second capacitor (C2) is connected to the second capacitor line (CL2), and the other end of the second capacitor (C2) is connected to the second mux line (ML2). The second capacitor (C2) receives a second capacitor signal (Cap2) through the second capacitor line (CL2) and the second capacitor (C2) is controlled by the second capacitor signal (Cap2). For example, when the second capacitor signal (Cap2) is high, the second capacitor (C2) is charged by the corresponding voltage, and when the second capacitor signal (Cap2) is low, the voltage charged in the second capacitor (C2) is discharged.

Figure 3:
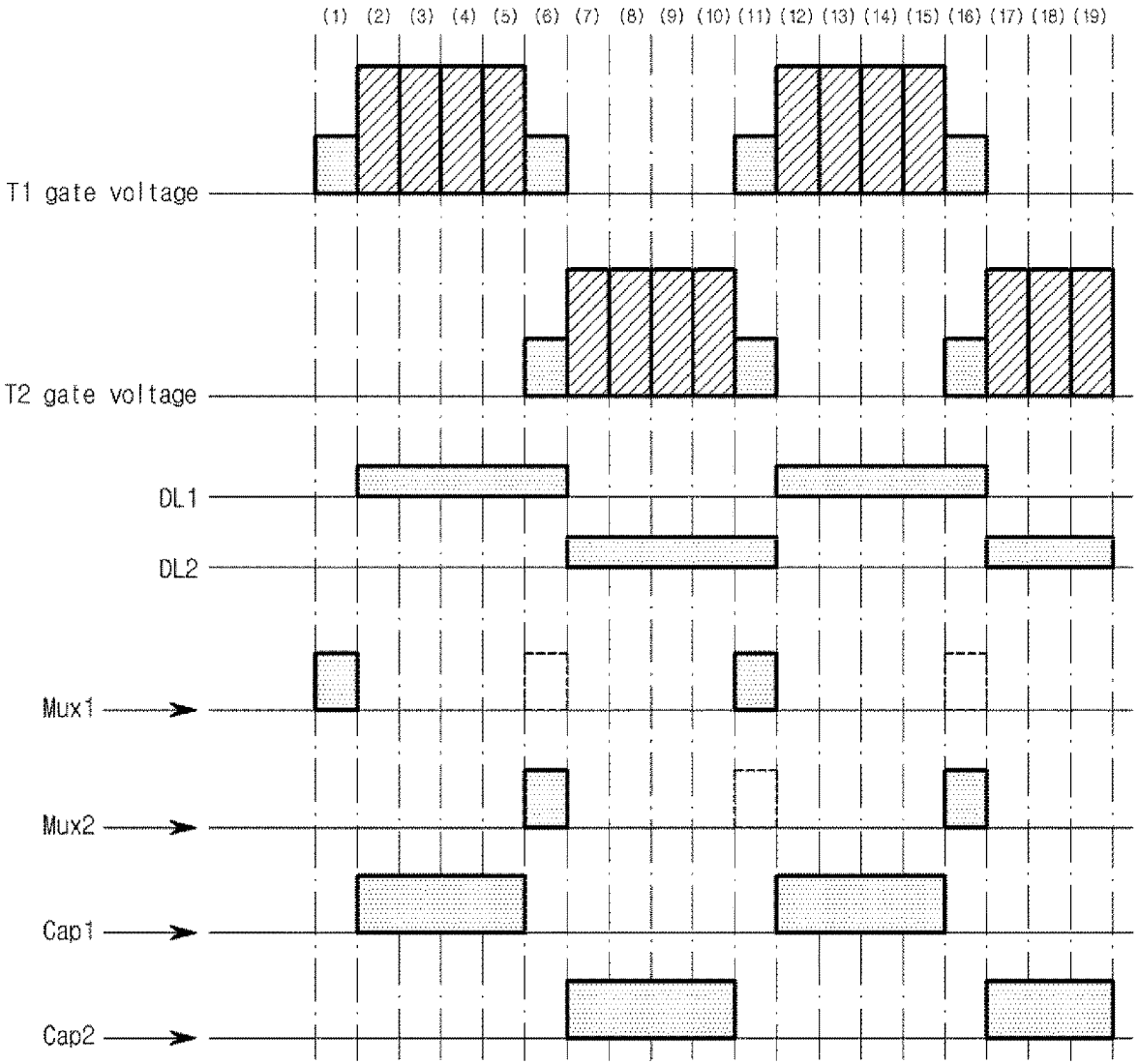
FIG. 3 is a timing diagram explaining an operation of the display device including the multiplexer shown in FIG. 2.

FIG. 3 is a timing diagram explaining an operation of the display device including the multiplexer shown in FIG. 2.

A T1 gate voltage is a signal measured (output) at the gate of the first TFT (T1), and a T2 gate voltage is a signal measured at the second TFT (T2).

Each of DL1 and DL2 are image data signals output from the first data line (DL1) and the second data line (DL2) to be input to the pixel of the display panel (PANEL), respectively.

The first mux signal (Mux1) indicates the voltage charging time point and the voltage discharge time point of the first mux line (ML1). That is, an arbitrary input part is present outside the gate driver (GD), the timing controller (TC), or the display panel (PANEL), and the arbitrary input part controls the voltage charging and the voltage discharging of the first mux line (ML1) by the first mux signal (Mux1).

The second mux signal (Mux2) indicates the voltage charging time point and the voltage discharging time point of the second mux line (ML2). That is, an arbitrary input part is present outside the gate driver (GD), the timing controller (TC), or the display panel (PANEL), and the arbitrary input part controls the voltage charging and the voltage discharging of the second mux line (ML2) by the second mux signal (Mux2).

The first capacitor signal (Cap1) is a signal input through the first capacitor line (CL1), and the second capacitor signal (Cap2) is a signal input through the second capacitor line (CL2).

In a section 1, the voltage of the first mux line (ML1) is charged by the first mux signal (Mux1). Therefore, the gate voltage (T1 gate voltage) of the first TFT (T1) is output as high and the first TFT (T1) is turned on.

In a section 2, the first capacitor signal (Cap1) is input as high. Therefore, the high output of the gate voltage (T1 gate voltage) of the first TFT (T1) increases compared to the section 1. Herein, the magnitude of the gate voltage (T1 gate voltage) of the first TFT (T1) output as high is equal to or smaller than the sum of the magnitude of the gate voltage of the first TFT (T1) in the section 1 and the magnitude of the first capacitor signal (Cap1) in the section 2.

Sections 3 to 5 are the same as the section 2.

In a section 6, a reset signal of the first mux signal (Mux1) is input, the voltage of the first mux line (ML1) is discharged, and the first capacitor signal (Cap1) is input as low.

In the sections 2 to 6, the image data are output from the first data line (DL1). That is, since the first TFT (T1) has been turned on, the image data are output from the first data line (DL1) connected to the first TFT (T1).

In the section 6, the voltage of the second mux line (ML2) is charged by the second mux signal (Mux2). Therefore, the gate voltage (T2 gate voltage) of the first TFT (T1) is output as high, and the second TFT (T2) is turned on.

In the section 7, the second capacitor signal (Cap2) is input as high.

Therefore, the high output of the gate voltage (T2 gate voltage) of the second TFT (T2) increases compared to the section 6. Herein, the magnitude of the gate voltage (T2 gate voltage) of the second TFT (T2) output as high is equal to or smaller than the sum of the magnitude of the gate voltage of the second TFT (T2) in the section 6 and the magnitude of the second capacitor signal (Cap2) in the section 7.

Sections 8 to 10 are the same as the section 7.

In a section 11, a reset signal of the second mux signal (Mux2) is input, the voltage of the second mux line (ML2) is discharged, and the second capacitor signal (Cap2) is input as low.

In the sections 7 to 11, the image data are output from the second data line (DL2). That is, since the second TFT (T2) has been turned on, the image data are output from the second data line (DL2) connected to the second TFT (T2).

A method for controlling the display device including the multiplexer according to the present disclosure will be described as follows.

Turning on the first TFT (T1) of the multiplexer by charging the voltage of the first mux line (ML1) is performed (section 1). Specifically, in the section 1, the voltage of the first mux line (ML1) is charged by the first mux signal (Mux1), therefore, the gate voltage (T1 gate voltage) of the first TFT (T1) is output as high, and therefore, the first TFT (T1) is turned on.

Turning on the second TFT (T2) of the multiplexer by charging the voltage of the second mux line (ML2) is performed (section 6). Specifically, in the section 6, the voltage of the second mux line (ML2) is charged by the second mux signal (Mux2), therefore, the gate voltage (T2 gate voltage) of the second TFT (T2) is output as high, and therefore, the second TFT (T2) is turned on.

In addition, charging the first capacitor (Cap1) having one end connected with the first capacitor line (CL1) and the other end connected with the first mux line (ML1) is performed (section 2). Specifically, in the section 2, the first capacitor signal (Cap1) is input as high, and therefore, the high output of the gate voltage (T1 gate voltage) of the first TFT (T1) increases compared to the previous section (section 1). That is, the gate voltage of the first capacitor (Cap1) is controlled not only by the charging voltage of the first mux line (ML1), but also by the charging voltage of the first capacitor (Cap1).

The display device including the multiplexer according to the present disclosure described with reference to FIGS. 2 and 3 can implement a high-voltage driving. That is, in controlling the turn-on and the turn-off of the first TFT (T1) or the second TFT (T2) that are the mux TFT included in the multiplexer, not only the voltages of the mux lines (ML1, ML2), but also the additional voltages of the capacitors (Cap1, Cap2) can be used together, thereby increasing the magnitudes of the gate voltages of the first TFT (T1) and the second TFT (T2).

In addition, the display device including the multiplexer according to the present disclosure described with reference to FIGS. 2 and 3 can implement a high-speed driving. That is, since the magnitudes of the voltages applied to the gates of the mux TFTs (T1, T2) have been increased, the switching speeds of the mux TFTs (T1, T2) can be increased.

Meanwhile, although it has been described above that the high of the first mux signal (Mux1) is earlier than the high of the first capacitor signal (Cap1) (sections 1 and 2), the high of the first mux signal (Mux1) and the high of the first capacitor signal (Cap1) can coincide with each other to be generated simultaneously. Likewise, although it has been described above as the high of the second mux signal (Mux2) precedes the high of the second capacitor signal (Cap2) (sections 6 and 7), the high of the second mux signal (Mux2) and the high of the second capacitor signal (Cap2) can coincide with each other to be generated simultaneously. In some embodiments, the signals may coincide as well as overlap with each other. For example, the high of the first mux signal (Mux1) and the high of the first capacitor signal (Cap1) can overlap with each other.

In addition, although it has been described above that the low of the first capacitor signal (Cap1) precedes the reset of the first mux signal (Mux1) (sections 5 and 6), the low of the first capacitor signal (Cap1) and the reset of the first mux signal (Mux1) can coincide with each other to be generated simultaneously. Likewise, although it has been described above that the low of the second capacitor signal (Cap2) is earlier than the reset of the second mux signal (Mux2) (sections 10 and 11), the low of the second capacitor signal (Cap2) and the reset of the second mux signal (Mux2) can coincide with each other to generate simultaneously.

Figure 4:
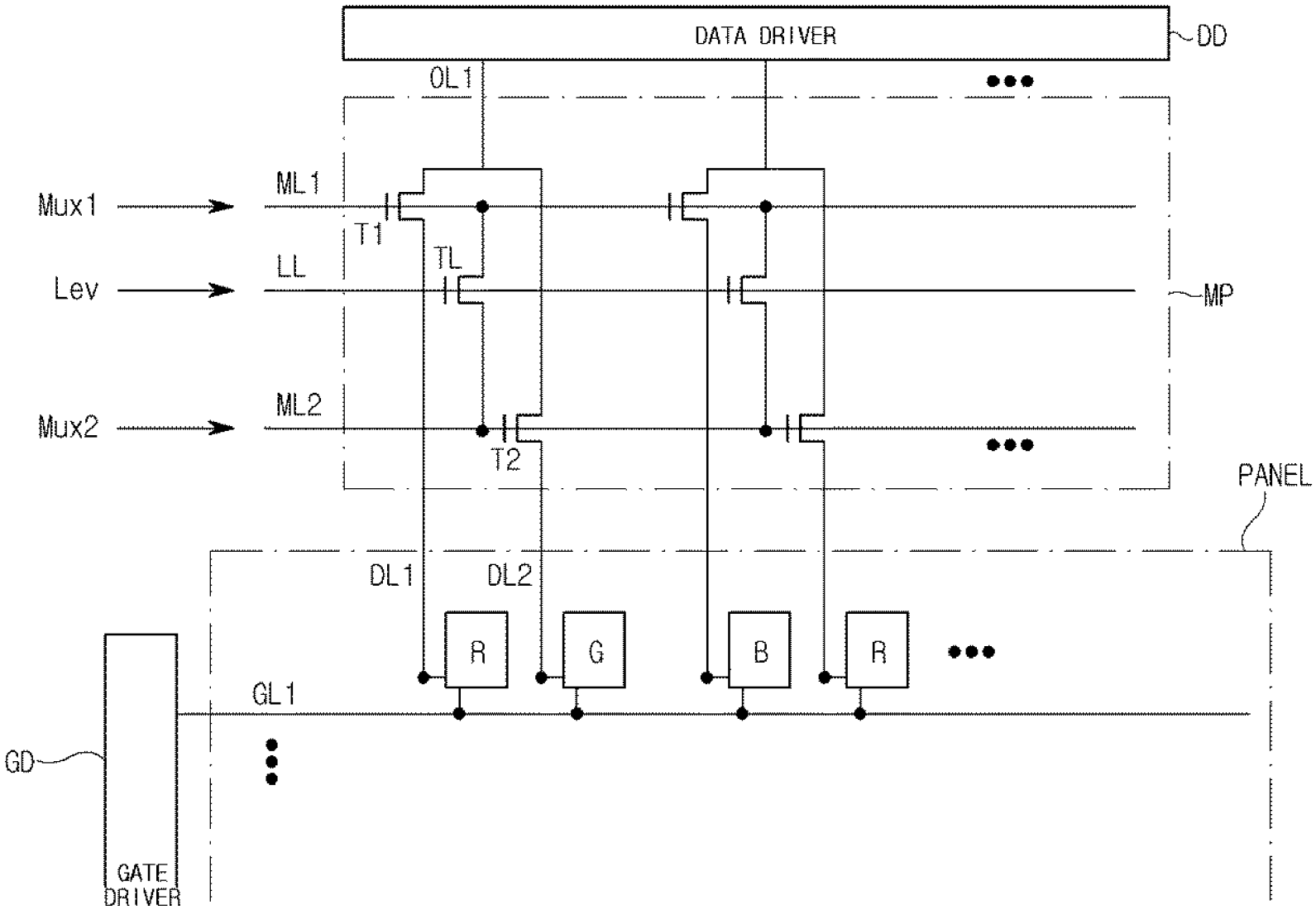
FIG. 4 is a diagram showing a display device including a multiplexer according to the present disclosure.

FIG. 4 is a diagram showing a display device including a multiplexer according to the present disclosure.

Referring to FIG. 4, a display device including a multiplexer according to the present disclosure includes a data driver (DD), a multiplexer (MP) connected with the data driver through the driving line (OL1), a display panel (PANEL) connected with the multiplexer (MP) through data lines (DL1, DL2), and a gate driver (GD) connected with the display panel (PANEL) through a gate line (GL1).

The multiplexer (MP) includes two mux TFTs (T1, T2) and one leveling TFT (TL). The voltage charging and voltage discharging of the first mux line (ML1) are controlled by the first mux signal (Mux1) controlled by an arbitrary input part, and the first TFT (T1) is controlled according to the charging and the discharging of this voltage. For example, when the voltage of the first mux line (ML1) is charged by the first mux signal (Mux1), the first TFT (T1) is turned on, and when the voltage of the first mux line (ML1) is discharged by the first mux signal (Mux1), the first TFT (T1) is turned off. In addition, the voltage charging and the voltage discharging of the second mux line (ML2) are controlled by the second mux signal (Mux2) controlled by an arbitrary input part, and the second TFT (T2) is controlled according to the charging and the discharging of this voltage. For example, when the voltage of the second mux line (ML2) is charged by the second mux signal (Mux2), the second TFT (T2) is turned on, and when the voltage of the second mux line (ML2) is discharged by the second mux signal (Mux2), the second TFT (T2) is turned off. The leveling TFT (TL) has one end connected to the first mux line (ML1), and the other end connected to the second mux line (ML2). In some embodiments, an end of a transistor may refer to an electrode or a conduction terminal of the transistor. For example, a first electrode or a first conduction terminal may refer to a source electrode of the transistor. Similarly, a second electrode or a second conduction terminal may refer to a drain electrode of the transistor. The first electrode may refer to a drain electrode and the second electrode may refer to a source electrode depending on the type and configuration of the transistor. A leveling signal (Lev) is received through a leveling line (LL) and the leveling TFT (TL) is controlled by this leveling signal (Lev). For example, when the leveling signal (Lev) is high, the leveling signal (Lev), which is high, is input to the gate of the leveling TFT (TL), such that the leveling TFT (TL) is turned on, and when the leveling signal (Lev) is low, a low voltage signal is input to the gate of the leveling TFT (TL), such that the leveling TFT (TL) is turned off.

Figure 5:
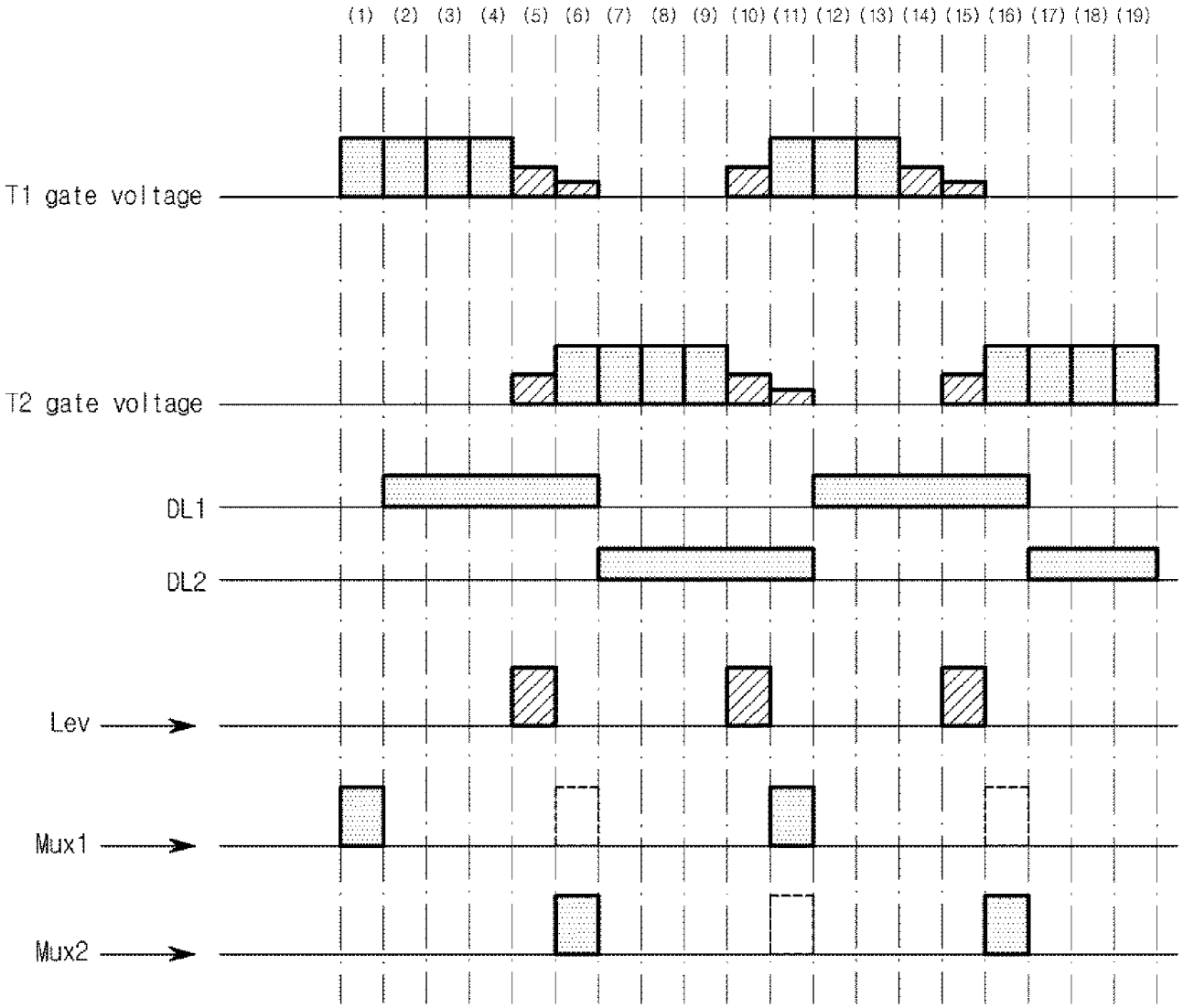
FIG. 5 is a timing diagram explaining the operation of the display device including the multiplexer shown in FIG. 4.

FIG. 5 is a timing diagram explaining the operation of the display device including the multiplexer shown in FIG. 4.

In a section 1, the voltage of the first mux line (ML1) is charged by the first mux signal (Mux1). Therefore, the gate voltage (T1 gate voltage) of the first TFT (T1) is output as high and the first TFT (T1) is turned on.

Sections 2 to 4 are the same as the section 1.

In a section 5, the leveling signal (Lev) is input as high. Therefore, the leveling TFT (TL) is turned on and the first mux line (ML1) and the second mux line (ML2) are connected to each other. Therefore, the gate voltage (T1 gate voltage) of the first TFT (T1) which was output as high in the previous section reduces, and the gate voltage (T2 gate voltage) of the second TFT (T2) which was output as low in the previous section increases. For example, the magnitude of the reduced gate voltage (T1 gate voltage) of the first TFT (T1) can be equal to the magnitude of the increased gate voltage (T2 gate voltage) of the second TFT (T2). That is, the gate voltage (T1 gate voltage) of the first TFT (T1) is transferred to the gate voltage (T2 gate voltage) of the second TFT (T2).

In the sections 2 to 6, the image data are output from the first data line (DL1). That is, since the first TFT (T1) has been turned on, the image data is output from the first data line (DL1) connected to the first TFT (T1).

In a section 6, the voltage of the second mux line (ML2) is charged by the second mux signal (Mux2). Therefore, the gate voltage (T2 gate voltage) of the second TFT (T2) is output as high, and the second TFT (T2) is turned on.

Sections 7 to 9 are the same as the section 6.

In a section 10, the leveling signal (Lev) is input as high. Therefore, the leveling TFT (TL) is turned on and the first mux line (ML1) and the second mux line (ML2) are connected to each other. Therefore, the gate voltage (T2 gate voltage) of the second TFT (T2) which was output as high in the previous section reduces, and the gate voltage (T1 gate voltage) of the first TFT (T1) which was output as low in the previous section increases. For example, the magnitude of the reduced gate voltage (T2 gate voltage) of the second TFT (T2) can be equal to the magnitude of the increased gate voltage (T1 gate voltage) of the first TFT (T1). That is, the gate voltage (T2 gate voltage) of the second TFT (T2) is transferred to the gate voltage (T1 gate voltage) of the first TFT (T1).

In the sections 7 to 11, the image data are output from the second data line (DL2). That is, since the second TFT (T2) has been turned on, the image data are output from the second data line (DL2) connected to the second TFT (T2).

The method for controlling the display device including the multiplexer according to the present disclosure will be described as follows.

Turning on the first TFT (T1) of the multiplexer by charging the voltage of the first mux line (ML1) is performed (section 1). Specifically, in the section 1, the voltage of the first mux line (ML1) is charged by the first mux signal (Mux1), therefore, the gate voltage (T1 gate voltage) of the first TFT (T1) is output as high, and therefore, the first TFT (T1) is turned on.

Turning on the second TFT (T2) of the multiplexer by charging the voltage of the second mux line (ML2) is performed (section 6). Specifically, in the section 6, the voltage of the second mux line (ML2) is charged by the second mux signal (Mux2), therefore, the gate voltage (T2 gate voltage) of the second TFT (T2) is output as high, and therefore, the second TFT (T2) is turned on.

In addition, turning on the leveling TFT (TL) having one end connected with the first mux line (ML1) and the other end connected with the second mux line (ML2) is performed (section 5). Specifically, in the section 5, the leveling signal (Lev) is input as high and therefore, the leveling TFT (TL) is turned on. Since the leveling TFT (TL) is turned on, the first mux line (ML1) and the second mux line (ML2) are connected to each other, the gate voltage (T1 gate voltage) of the first TFT (T1) which was output as high in the previous section reduces, and the gate voltage (T2 gate voltage) of the second TFT (T2) which was output as low in the previous section increases. For example, the magnitude of the reduced gate voltage (T1 gate voltage) of the first TFT (T1) can be equal to the magnitude of the increased gate voltage (T2 gate voltage) of the second TFT (T2). That is, the gate voltage (T1 gate voltage) of the first TFT (T1) is transferred to the gate voltage (T2 gate voltage) of the second TFT (T2).

The display device including the multiplexer according to the present disclosure described with reference to FIGS. 4 and 5 can implement a low-consumption power driving. That is, in increasing the gate voltage of the second TFT (T2) from low to high, the voltage of the first mux line (ML1) as well as the voltage of the second mux line (ML2) can be used (sections 5 and 6), thereby reducing the magnitude of the external power consumed for charging the voltage of the second mux line (ML2) necessary for increasing the gate voltage of the second TFT (T2). In addition, in increasing the gate voltage of the first TFT (T1) from low to high, the voltage of the second mux line (ML2) as well as the voltage of the first mux line (ML1) can be used (sections 10 and 11), thereby reducing the magnitude of the external power consumed for charging the voltage of the first mux line (ML1) necessary for increasing the gate voltage of the first TFT (T1).

In addition, the display device including the multiplexer according to the present disclosure described with reference to FIGS. 4 and 5 can implement a high-speed driving. That is, it is possible to increase the gate voltages of the mux TFTs (T1, T2) necessary for the turn-on control of the mux TFTs (T1, T2), thereby increasing the switching speed between the mux TFTs.

Figure 6:
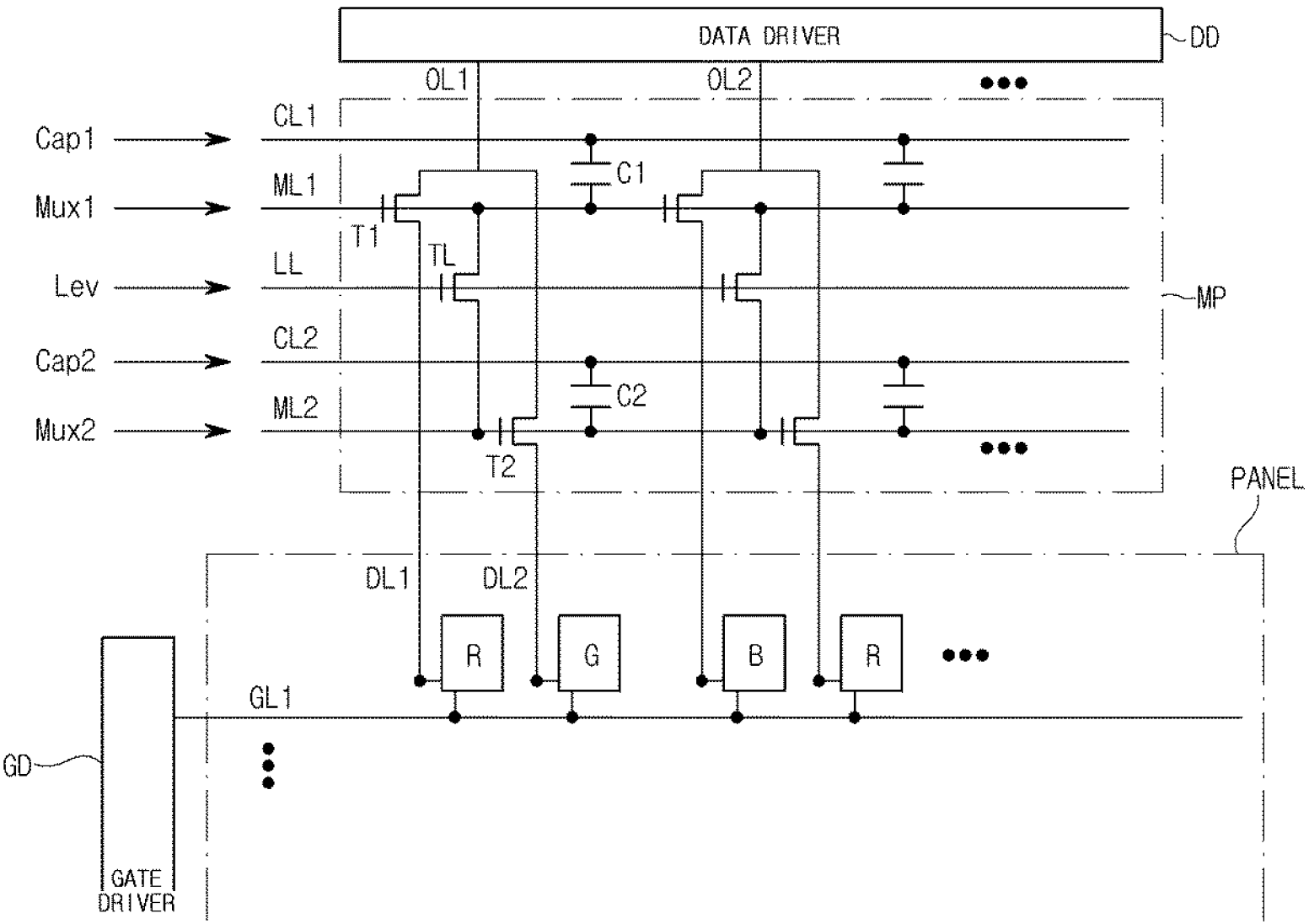
FIG. 6 is a diagram showing a display device including a multiplexer according to the present disclosure.

FIG. 6 is a diagram showing a display device including a multiplexer according to the present disclosure.

Referring to FIG. 6, a display device including a multiplexer according to the present disclosure includes a data driver (DD), a multiplexer (MP) connected with the data driver through a driving line (OL1), a display panel (PANEL) connected with the multiplexer (MP) through data lines (DL1, DL2), and a gate driver (GD) connected with the display panel (PANEL) through a gate line (GL1).

In some embodiments, the multiplexer (MP) includes two mux TFTs (T1, T2) and one leveling TFT (TL). The voltage charging and the voltage discharging of the first mux line (ML1) are controlled by the first mux signal (Mux1) controlled by an arbitrary input part, and the first TFT (T1) is controlled according to the charging and the discharging of this voltage. For example, when the voltage of the first mux line (ML1) is charged by the first mux signal (Mux1), the first TFT (T1) is turned on, and when the voltage of the first mux line (ML1) is discharged by the first mux signal (Mux1), the first TFT (T1) is turned off. In addition, the voltage charging and the voltage discharging of the second mux line (ML2) are controlled by the second mux signal (Mux2) controlled by an arbitrary input part, and the second TFT (T2) is controlled according to the charging and the discharging of this voltage. For example, when the voltage of the second mux line (ML2) is charged by the second mux signal (Mux2), the second TFT (T2) is turned on, and when the voltage of the second mux line (ML2) is discharged by the second mux signal (Mux2), the second TFT (T2) is turned off. The leveling TFT (TL) has one end connected to the first mux line (ML1) and the other end connected to the second mux line (ML2). The leveling signal (Lev) is received through the leveling line (LL) and the leveling TFT (TL) is controlled by this leveling signal (Lev). For example, when the leveling signal (Lev) is high, the leveling signal (Lev), which is high, is input to the gate of the leveling TFT (TL), such that the leveling TFT (TL) is turned on, and when the leveling signal (Lev) low, the low voltage signal is input to the gate of the leveling TFT (TL), such that the leveling TFT (TL) is turned off.

In some embodiments, the multiplexer (MP) includes two capacitors (C1, C2). One end of the first capacitor (C1) is connected to the first capacitor line (CL1), and the other end of the first capacitor (C1) is connected to the first mux line (ML1). The first capacitor (C1) receives the first capacitor signal (Cap1) through the first capacitor line (CL1) and the first capacitor (C1) is controlled by the first capacitor signal (Cap1). For example, when the first capacitor signal (Cap1) is high, the first capacitor (C1) is charged by the corresponding voltage, and when the first capacitor signal (Cap1) is low, the voltage charged in the first capacitor (C1) is discharged. One end of the second capacitor (C2) is connected to the second capacitor line (CL2), and the other end of the second capacitor (C2) is connected to the second mux line (ML2). The second capacitor (C2) receives the second capacitor signal (Cap2) through the second capacitor line (CL2) and the second capacitor (C2) is controlled by the second capacitor signal (Cap2). For example, when the second capacitor signal (Cap2) is high, the second capacitor (C2) is charged by the corresponding voltage, and when the second capacitor signal (Cap2) is low, the voltage charged in the second capacitor (C2) is discharged.

Figure 7:
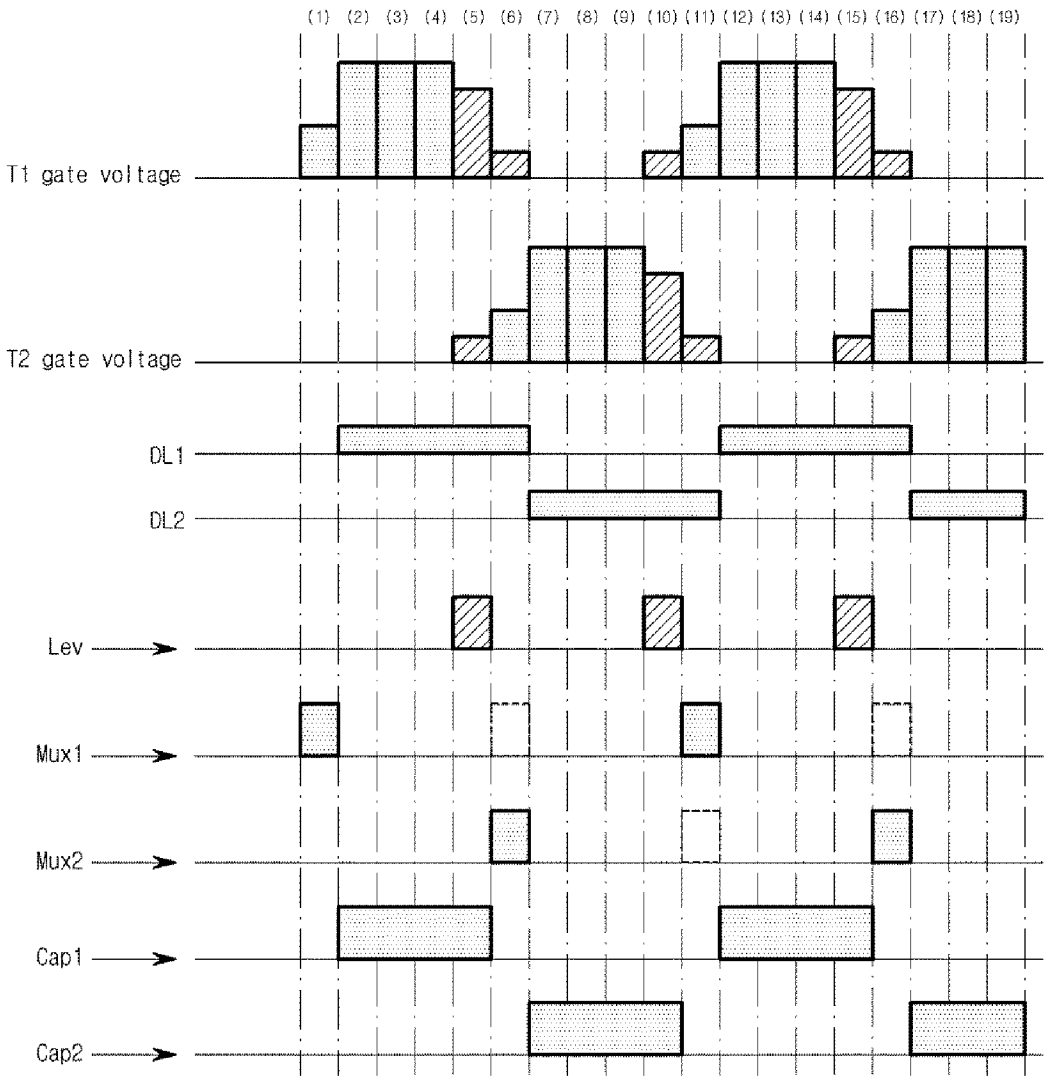
FIG. 7 is a timing diagram explaining the operation of the display device including the multiplexer shown in FIG. 6.

FIG. 7 is a timing diagram explaining the operation of the display device including the multiplexer shown in FIG. 6.

In a section 1, the voltage of the first mux line (ML1) is charged by the first mux signal (Mux1). Therefore, the gate voltage (T1 gate voltage) of the first TFT (T1) is output as high and the first TFT (T1) is turned on.

In a section 2, the first capacitor signal (Cap1) is input as high. Therefore, the gate voltage (T1 gate voltage) of the first TFT (T1) is output as high. Herein, the magnitude of the gate voltage (T1 gate voltage) of the first TFT (T1) output as high is equal to or smaller than the sum of the magnitude of the first mux signal (Mux1) in the section 1 and the magnitude of the first capacitor signal (Cap1) in the section 2.

Sections 3 and 4 are the same as the section 2.

In a section 5, the leveling signal (Lev) is input as high. Therefore, the leveling TFT (TL) is turned on and the first mux line (ML1) and the second mux line (ML2) are connected to each other. Therefore, the gate voltage (T1 gate voltage) of the first TFT (T1) output as high in the previous section reduces, and the gate voltage (T2 gate voltage) of the second TFT (T2) output as low in the previous section increases. For example, the magnitude of the reduced gate voltage (T1 gate voltage) of the first TFT (T1) can be equal to the magnitude of the increased gate voltage (T2 gate voltage) of the second TFT (T2). That is, the gate voltage (T1 gate voltage) of the first TFT (T1) is transferred to the gate voltage (T2 gate voltage) of the second TFT (T2).

In a section 6, the reset signal of the first mux signal (Mux1) is input, and the first capacitor signal (Cap1) is input as low.

In the sections 2 to 6, the image data are output from the first data line (DL1). That is, since the first TFT (T1) has been turned on, the image data are output from the first data line (DL1) connected to the first TFT (T1).

In the section 6, the voltage of the second mux line (ML2) is charged by the second mux signal (Mux2). Therefore, the gate voltage (T2 gate voltage) of the second TFT (T2) is output as high, and the second TFT (T2) is turned on.

In a section 7, the second capacitor signal (Cap2) is input as high. Therefore, the gate voltage (T2 gate voltage) of the second TFT (T2) is output as high. Herein, the magnitude of the gate voltage (T2 gate voltage) of the second TFT (T2) output as high is equal to or smaller than the sum of the magnitude of the second mux signal (Mux2) in the section 6 and the magnitude of the second capacitor signal (Cap2) in the section 7.

Sections 8 and 9 are the same as the section 7.

In a section 10, the leveling signal (Lev) is input as high. Therefore, the leveling TFT (TL) is turned on and the first mux line (ML1) and the second mux line (ML2) are connected to each other. Therefore, the gate voltage (T2 gate voltage) of the second TFT (T2) output as high in the previous section is reduced, and the gate voltage (T1 gate voltage) of the first TFT (T1) output as low in the previous section increases. For example, the magnitude of the reduced gate voltage (T2 gate voltage) of the second TFT (T2) can be equal to the magnitude of the increased gate voltage (T1 gate voltage) of the first TFT (T1). That is, the gate voltage (T2 gate voltage) of the second TFT (T2) is transferred to the gate voltage (T1 gate voltage) of the first TFT (T1).

In a section 11, the reset signal of the second mux signal (Mux2) is input, and the second capacitor signal (Cap2) is input as low.

In the sections 7 to 11, the image data are output from the second data line (DL2). That is, since the second TFT (T2) has been turned on, the image data are output from the second data line (DL2) connected to the second TFT (T2).

The display device including the multiplexer according to the present disclosure described with reference to FIGS. 6 and 7 can implement a high-voltage driving. That is, in controlling the turn-on and the turn-off of the first TFT (T1) or the second TFT (T2), which are the mux TFTs included in the multiplexer, not only the voltages of the mux lines (ML1, ML2) but also the additional voltages of the capacitors (C1, C2) can be used together, thereby increasing the magnitude of the gate voltages of the first TFT (T1) and the second TFT (T2).

In addition, the display device including the multiplexer according to the present disclosure described with reference to FIGS. 6 and 7 can implement a high-speed driving. That is, since the magnitudes of the voltages applied to the gates of the mux TFTs (T1, T2) have been increased, the switching speeds of the mux TFTs (T1, T2) can be increased.

In addition, the display device including the multiplexer according to the present disclosure described with reference to FIGS. 6 and 7 can implement a low-consumption power driving. That is, in increasing the gate voltage of the second TFT (T2) from low to high, the voltage of the first mux line (ML1) as well as the voltage of the second mux line (ML2) can be used (sections 5 and 6), thereby reducing the magnitude of the external power consumed for charging the voltage of the second mux line (ML2) necessary for increasing the gate voltage of the second TFT (T2). In addition, in increasing the gate voltage of the first TFT (T1) from low to high, the voltage of the second mux line (ML2) as well as the voltage of the first mux line (ML1) can be used (sections 10 and 11), thereby reducing the magnitude of the external power consumed for charging the voltage of the first mux line (ML1) necessary for increasing the gate voltage of the first TFT (T1).

Meanwhile, although it has been described above that the high of the first mux signal (Mux1) is earlier than the high of the first capacitor signal (Cap1) (sections 1 and 2), the high of the first mux signal (Mux1) and the high of the first capacitor signal (Cap1) can coincide with each other to generate simultaneously. Likewise, although it has been described above that the high of the second mux signal (Mux2) is earlier than the high of the second capacitor signal (Cap2) (sections 6 and 7), the high of the second mux signal (Mux2) and the high of the second capacitor signal (Cap2) can coincide with each other to generate simultaneously.

In addition, although it has been described above that the low of the first capacitor signal (Cap1) precedes the reset of the first mux signal (Mux1) (sections 5 and 6), the low of the first capacitor signal (Cap1) and the reset of the first mux signal (Mux1) can coincide with each other to be generated simultaneously. Likewise, although it has been described above that the low of the second capacitor signal (Cap2) precedes the reset of the second mux signal (Mux2) (sections 10 and 11), the low of the second capacitor signal (Cap2) and the reset of the second mux signal (Mux2) can coincide with each other to be generated simultaneously.

Figure 8:
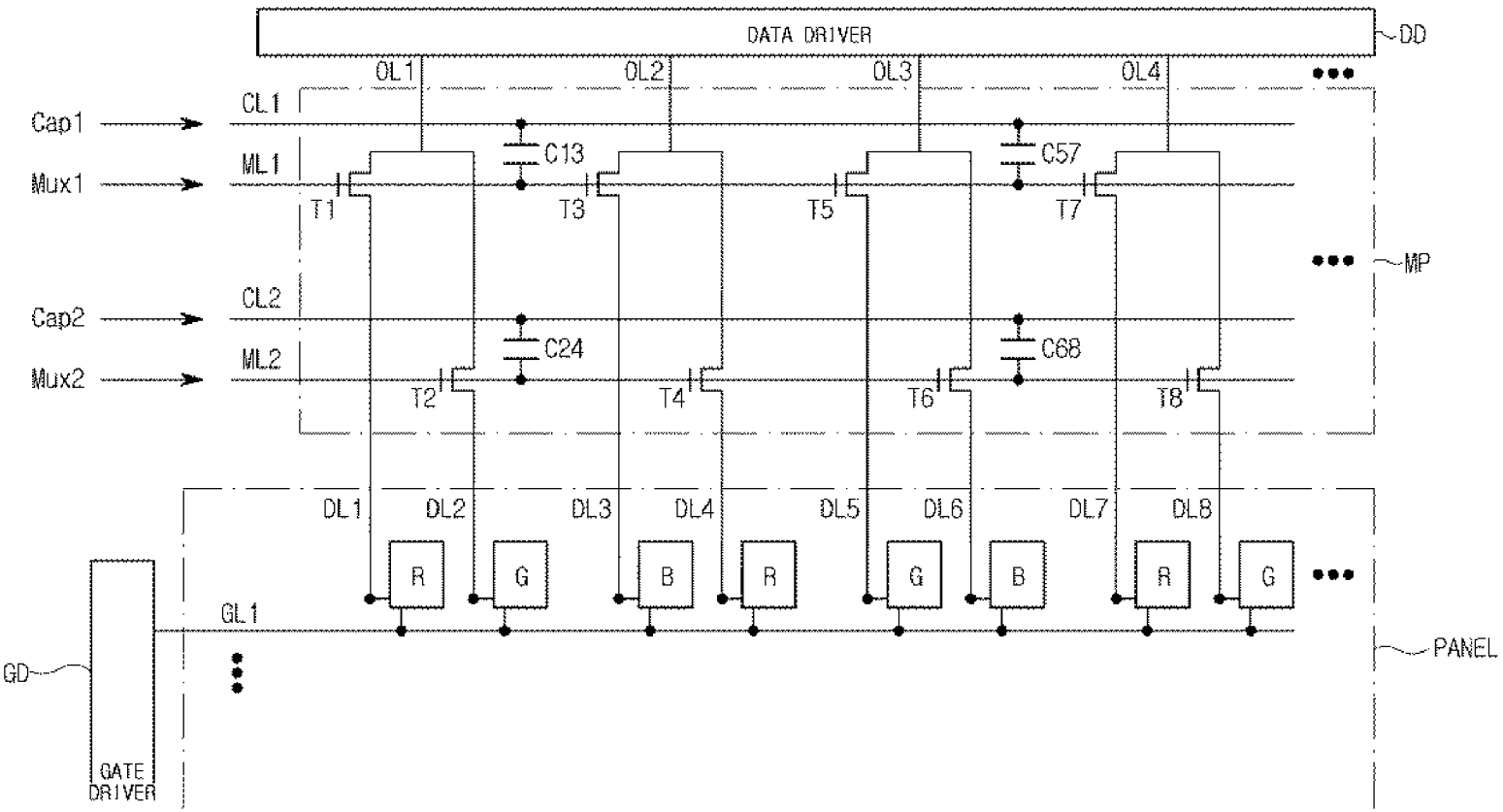
FIG. 8 is a diagram showing a display device including a multiplexer according to the present disclosure.

FIG. 8 is a diagram showing a display device including a multiplexer according to the present disclosure.

Referring to FIG. 8, a display device including a multiplexer according to the present disclosure includes a data driver (DD), a multiplexer (MP) connected with the data driver through a driving line (OL1), a display panel (PANEL) connected with the multiplexer (MP) through data lines (DL1, DL2), and a gate driver (GD) connected with the display panel (PANEL) through a gate line (GL1).

In some embodiments, the multiplexer (MP) includes four mux TFTs (T1, T2, T3, T4). The voltage charging and the voltage discharging of the first mux line (ML1) are controlled by the first mux signal (Mux1) controlled by an arbitrary input part, and the first TFT (T1) is controlled according to the charging and the discharging of this voltage. For example, when the voltage of the first mux line (ML1) is charged by the first mux signal (Mux1), the first TFT (T1) is turned on, and when the voltage of the first mux line (ML1) is discharged by the first mux signal (Mux1), the first TFT (T1) is turned off. In addition, the voltage charging and the voltage discharging of the second mux line (ML2) are controlled by the second mux signal (Mux2) controlled by an arbitrary input part, and the second TFT (T2) is controlled according to the charging and the discharging of this voltage. For example, when the voltage of the second mux line (ML2) is charged by the second mux signal (Mux2), the second TFT (T2) is turned on, and when the voltage of the second mux line (ML2) is discharged by the second mux signal (Mux2), the second TFT (T2) is turned off. The voltage charging and the voltage discharging of the first mux line (ML1) are controlled by the first mux signal (Mux1) controlled by an arbitrary input part, and the third TFT (T3) is controlled according to the charging and the discharging of this voltage. For example, when the voltage of the first mux line (ML1) is charged by the first mux signal (Mux1), the third TFT (T3) is turned on, and when the voltage of the first mux line (ML1) is discharged by the first mux signal (Mux1), the third TFT (T3) is turned off. In addition, the voltage charging and the voltage discharging of the second mux line (ML2) are controlled by the second mux signal (Mux2) controlled by an arbitrary input part, and the fourth TFT (T4) is controlled according to the charging and the discharging of this voltage. For example, when the voltage of the second mux line (ML2) is charged by the second mux signal (Mux2), the fourth TFT (T4) is turned on, and when the voltage of the second mux line (ML2) is discharged by the second mux signal (Mux2), the fourth TFT (T4) is turned off.

In some embodiments, the multiplexer (MP) includes two capacitors (C13, C24). One end of the first capacitor (C13) is connected to the first capacitor line (CL1), and the other end of the first capacitor (C13) is connected to the first mux line (ML1). The first capacitor (C13) receives the first capacitor signal (Cap1) through the first capacitor line (CL1) and the first capacitor (C13) is controlled by the first capacitor signal (Cap1). For example, when the first capacitor signal (Cap1) is high, the first capacitor (C13) is charged by the corresponding voltage, and when the first capacitor signal (Cap1) is low, the voltage charged in the first capacitor (C13) is discharged. One end of the second capacitor (C24) is connected to the second capacitor line (CL2), and the other end of the second capacitor (C24) is connected to the second mux line (ML2). The second capacitor (C24) receives the second capacitor signal (Cap2) through the second capacitor line (CL2) and the second capacitor (C24) is controlled by the second capacitor signal (Cap2). For example, when the second capacitor signal (Cap2) is high, the second capacitor (C24) is charged by the corresponding voltage, and when the second capacitor signal (Cap2) is low, the voltage charged in the second capacitor (C24) is discharged.

The multiplexer according to an embodiment described with reference to FIG. 8 is a structure in which the first TFT (T1) and the third TFT (T3) share the first capacitor (C13), and the second TFT (T2) and the fourth TFT (T4) share the second capacitor (C24). That is, the voltage charged in the first capacitor (C13) is used for the high-voltage driving of the first TFT (T1) and at the same time, for the high-voltage driving of the third TFT (T3). In addition, the voltage charged in the second capacitor (C24) is used for the high-voltage driving of the second TFT (T2) and at the same time, for the high-voltage driving of the fourth TFT (T4). That is, an embodiment shown in FIG. 8 is a structure in which a plurality of mux TFTs use a single capacitor commonly.

On the contrary, the multiplexer according to an embodiment described with reference to FIG. 2 is a structure in which the first TFT (T1) exclusively uses the first capacitor (C1), and the second TFT (T2) exclusively uses the second capacitor (C2). That is, an embodiment of FIG. 2 is a structure in which one mux TFT uses a single capacitor alone.

The display device including the multiplexer according to the present disclosure described with reference to FIG. 8 can implement the high-voltage driving, thereby reducing the area of the layout necessary for manufacturing the display.

The various embodiments described above can be combined to provide further embodiments. Additional changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device, comprising:

a data driver for outputting image data;

a multiplexer connected to the data driver through a driving line, the multiplexer including:

a first mux line;

a first transistor controlled by a charging and a discharging of the first mux line;

a second mux line; and a second transistor controlled by a charging and a discharging of the second mux line;

a display panel connected to the multiplexer through a data line;

a gate driver connected to the display panel through a gate line; and a leveling transistor having a first conduction terminal connected with the first mux line and a second conduction terminal connected with the second mux line, wherein the leveling transistor is controlled by a signal of a leveling line coupled to a gate electrode of the leveling transistor, and wherein the leveling line is different from each of the first mux line and the second mux line.

2. The display device of claim 1, wherein the multiplexer further includes:

a first capacitor line;

a first capacitor having a first electrode connected with the first capacitor line and a second electrode connected with the first mux line;

a second capacitor line; and a second capacitor having a first electrode connected with the second capacitor line and a second electrode connected with the second mux line.

3. The display device of claim 2, wherein a gate voltage of the first transistor is controlled by a charging voltage of the first mux line and a charging voltage of the first capacitor, and wherein a gate voltage of the second transistor is controlled by a charging voltage of the second mux line and a charging voltage of the second capacitor.

4. The display device of claim 2, wherein the multiplexer further includes a third transistor controlled by a first mux signal transmitted to the first mux line; and a fourth transistor controlled by a second mux signal transmitted to the second mux line, and is configured to share a charging voltage of the first capacitor with the first transistor and the third transistor, and is configured to share a charging voltage of the second capacitor with the second transistor and the fourth transistor.

5. The display device of claim 1, wherein when the leveling transistor is turned on by a signal of a leveling line, a gate voltage of the first transistor is transferred to a gate of the second transistor.

6. A method for controlling a display device having a multiplexer, comprising:

turning on a first transistor of the multiplexer by a charging voltage of a first mux line;

turning on a second transistor of the multiplexer by a charging voltage of a second mux line; and turning on a leveling transistor having a first conduction terminal connected with the first mux line and a second conduction terminal connected with the second mux line, wherein the leveling transistor is turned on by a signal of a leveling line connected to a gate electrode of the leveling transistor, and wherein the leveling line is different from each of the first mux line and the second mux line.

7. The method for controlling the display device of claim 6, further comprising:

charging a first capacitor having a first plate connected with a first capacitor line and a second plate connected with the first mux line.

8. The method for controlling the display device of claim 7, further comprising:

controlling a gate voltage of the first transistor by a charging voltage of the first mux line and a charging voltage of the first capacitor.

9. The method for controlling the display device of claim 6, further comprising:

transferring a gate voltage of the first transistor to the gate of the second transistor, when the leveling transistor is turned on.

* * * * *